United States Patent [19]

Woodruff

[11] 4,137,013

[45] Jan. 30, 1979

[54] VARIABLE DISPLACEMENT PISTON PUMP

[75] Inventor: Frank Woodruff, New Hartford, N.Y.

[73] Assignee: The Bendix Corporation, Teterboro, N.J.

[21] Appl. No.: 835,623

[22] Filed: Sep. 22, 1977

[51] Int. Cl.[2] ..... F04B 1/28

[52] U.S. Cl. ..... 417/222

[58] Field of Search ..... 417/218, 269, 270, 222; 91/486, 504, 505, 506

[56] References Cited

U.S. PATENT DOCUMENTS

| | | | |
|---|---|---|---|
| 3,575,534 | 4/1971 | Leduc | 417/218 |
| 3,721,161 | 3/1973 | Bobst | 91/486 |
| 3,789,740 | 2/1974 | Boyer | 91/486 |
| 3,873,240 | 3/1975 | Leduc | 417/222 |

FOREIGN PATENT DOCUMENTS

| | | | |
|---|---|---|---|
| 508854 | 1/1955 | Canada | 91/504 |
| 860429 | 1/1941 | France | 417/269 |
| 1045463 | 11/1953 | France | 417/274 |
| 585940 | 11/1958 | Italy | 417/270 |
| 4565 | 1/1966 | Japan | 91/505 |
| 365283 | 11/1959 | Switzerland | 91/504 |

*Primary Examiner*—William L. Freeh
*Attorney, Agent, or Firm*—Anthony F. Cuoco

[57] ABSTRACT

A variable displacement pump includes a plurality of pistons and a swash plate arranged therewith, with the swash plate angularly displaced in response to pump discharge manifold pressure via a hydrostatic thrust bearing arrangement for controlling the stroke of the pistons to maintain a predetermined substantially constant pressure with a variable flow of fluid through the pump.

6 Claims, 1 Drawing Figure

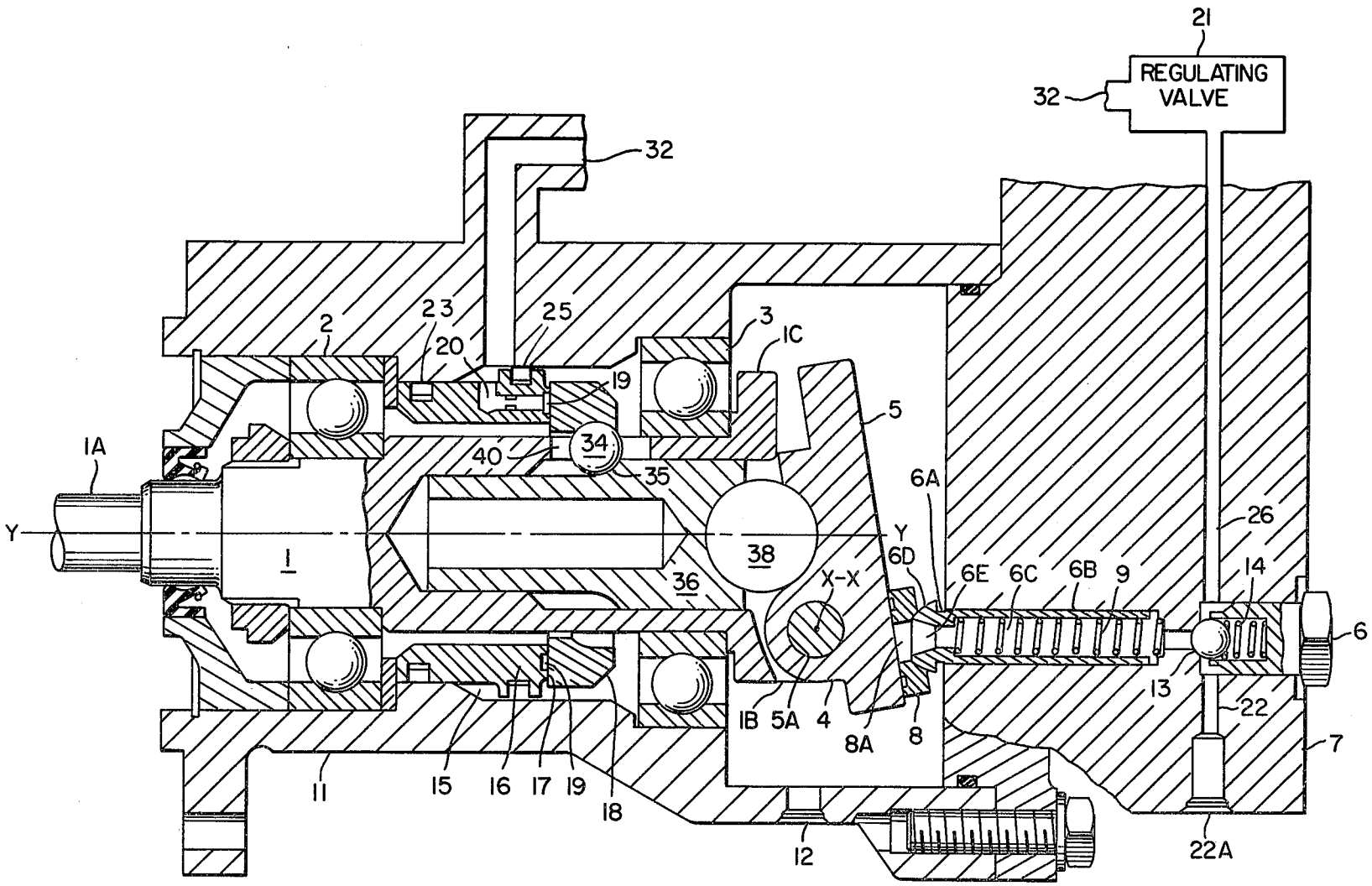
REGULATING VALVE
21
32
6
7
26
14
22
22A
13
9
6B
6C
6E
6A
6D
Y
8
8A
5
X-X
4
5A
1B
12
1C
3
38
36
35
34
19
18
17
16
15
25
40
20
23
2
1
11
1A
Y

VARIABLE DISPLACEMENT PISTON PUMP

CROSS REFERENCE TO RELATED APPLICATIONS

The pump disclosed herein is an improvement over the pump disclosed in commonly assigned copending U.S. application Ser. No. 796,933, filed by Frank Woodruff on May 16, 1977.

BACKGROUND OF THE INVENTION

1. Field of the Invention

This invention relates generally to variable displacement piston pumps and, particularly, to pumps of the type described which are compensated for maintaining constant pressure with variable flow. More particularly, this invention relates the hydrostatic means for controlling the stroke of the pump pistons to provide the aforenoted compensation.

2. Description of the Prior Art

The pump disclosed is particularly intended for use in electronic actuator diesel fuel injection systems. For this application and for other applications, a minimal pressure ripple or variation with a variation in fluid flow is desirable. Check valve type pumps, which are well known in the art, fulfill this requirement by including check valves for controlling pump discharge and/or inlet functions, and further include an arrangement for varying the stroke of the pump pistons. In pumps of this type, the pressure in the piston cylinders must be slightly greater than the pressure in the discharge manifold before the check valve opens. This is contrary to rotating cylinder block type pumps wherein communication is established between the cylinders and the discharge manifold at some predetermined pump shaft angle, without regard to the respective pressures. The pump disclosed in aforenoted U.S. application Ser. No. 796,933 features an arrangement affected by pump discharge manifold pressure for transmitting a thrust load to vary the stroke of the pump pistons. The arrangement disclosed requires relatively expensive thrust bearing. The present invention uses a less expensive hydrostatic bearing arrangement for this purpose.

SUMMARY OF THE INVENTION

This invention contemplates a variable displacement piston pump including a shaft having a driven end and an opposite end arranged for supporting a swash plate to pivot about an axis displaced from and normal to the center line of the shaft. A plurality of pistons having hollow cylinders extending therethrough are arranged with corresponding check valves in a pump block. During the "delivery" stroke of the pistons the pressure in the cylinders becomes sufficient to actuate the check valves, whereby fluid is delivered to a common discharge manifold. When the manifold pressure approaches a predetermined value, a force is created which is transmitted through a hydrostatic thrust bearing arrangement to the swash plate and pivots the plate away from a maximum flow position. The pistons are arranged with the swash plate so that when the swash plate pivots, the stroke of the pistons is decreased to reduce fluid flow and pressure. Equilibrium is thus established and a reduced fluid flow at a predetermined substantially constant pressure is maintained.

One object of this invention is to provide a variable displacement piston pump having the capability of maintaining a predetermined substantially constant pressure with a variable flow of fluid through the pump.

Another object of this invention is to provide a swash plate arranged with the pump pistons so that when the pump discharge manifold pressure approaches a predetermined value, the swash plate is displaced away from a maximum flow position, whereupon the stroke of the pistons is decreased to reduce fluid flow and pressure and to establish an equilibrium state whereby the reduced fluid flow is maintained at a predetermined substantially constant pressure.

Another object of this invention is to utilize a hydrostatic thrust bearing arrangement responsive to the predetermined manifold pressure to displace the swash plate from the maximum flow position.

Another object of this invention is to provide a pump of the type described which contains fewer parts than prior art pumps for similar purposes, and which is inexpensive to manufacture and of rugged design.

The foregoing and other objects and advantages of the invention will appear more fully hereinafter from a consideration of the detailed description which follows, taken together with the accompanying drawing wherein one embodiment of the invention is illustrated by way of example. It is to be expressly understood, however, that the drawing is for illustration purposes only and is not to be construed as defining the limits of the invention.

DESCRIPTION OF THE DRAWINGS

The single FIGURE in the drawing is a sectioned front plan view of a pump according to the invention.

DESCRIPTION OF THE INVENTION

With reference to the FIGURE, there is shown a shaft designated by the numeral 1, and which shaft 1 is journalled in ball bearings 2 and 3 suitably mounted in a casing 11. An end 1A of shaft 1 is arranged to be suitably coupled to an engine or other external driving means (not shown) so as to be driven thereby, while the opposite end 1B of the shaft forms a trunnion mounting 4.

A swash plate 5 is pivotally supported on trunnion mounting 4 by a pivot pin 5A so as to pivot about a trunnion mounting axis X—X. It will be noted that trunnion mounting axis X—X is displaced from and normal to the center line Y—Y of shaft 1. Swash plate 5 is limited in its counterclockwise pivoting by a shoulder member 1C carried by end 1B of shaft 1.

The pump of the invention includes a plurality of piston assemblies 6, arranged as indicated in the aforenoted U.S. application Ser. No. 796,933. One such piston assembly is shown in the FIGURE and will be described for purposes of illustrating the present invention. The piston assemblies are arranged in a cylinder block 7.

Piston assembly 6 includes a piston 6A slideably supported in a bore 6B in block 7 and including a hollow cylinder 6C. A shoe 8 is disposed intermediate a spherical end 6D of piston 6A and swash plate 5.

It will be understood by those skilled in the art that the bearing unit loading of the shoe/piston and shoe/swash plate arrangements as shown is limited by "pressure balancing". Piston assembly 6 includes a return spring 9 disposed within piston cylinder 6C which serves to extend piston 6A on the "intake" stroke and to trap shoe 8 between piston end 6D and swash plate 5 when the pressure in piston cylinder 6C is absent or inadequate as will hereinafter become evident.

Upon rotation of shaft 1, during the "intake" stroke, fluid flows into the expanding piston cylinder volume through a port in swash plate 5 (not shown) as described in the aforenoted U.S. application Ser. No 796,933. Pump casing 11 is internally flooded through fluid entering an inlet port 12 and, thereupon passing through an aperture 8A in shoe 8 in communication with the swash plate port and an aperture 6E in piston end 6D in communication with aperture 8A and in communication with piston cylinder 6C. Piston cylinder 6C is arranged with a check valve ball 13 included in piston assembly 6. In this connection it is noted that although a ball type check valve is shown, other type check valves may be used as well, as will now be understood by those skilled in the art.

When piston 6A has passed top dead center, aperture 8A in shoe 8 no longer communicates with the swash plate port and hence piston cylinder 6C is closed and passage of fluid therethrough is blocked. Piston 6A starts its "delivery" stroke, and when the pressure in piston cylinder 6C is sufficient to displace check valve ball 13, lightly loaded by a spring 14, from its seat, fluid is delivered through the piston cylinder to a common discharge manifold 22 including a discharge port 22A and through a conduit or the like 26 which may communicate with a servo valve or the like (not shown). The attitude of swash plate 5 shown in the FIGURE is indicative of a maximum piston stroke and pump displacement.

A regulating valve designated generally by the numeral 21 is disclosed in commonly assigned copending U.S. application Ser. No. 836,264, filed on Sept. 26, 1977 by Frank Woodruff, and need not be described in detail for purposes of the present invention, other than to say that the valve is in communication with discharge manifold 22 through conduit 26 and delivers a modulated pressure to pump casing 11 through a conduit or the like 32.

The function of regulating valve 21 is to sense discharge manifold pressure and to modulate the pressure in a chamber 15 through conduit 32 to provide a control pressure for purposes to be hereinafter described. Chamber 15 is formed by a differential area piston 16 slidingly arranged within pump casing 11 and suitably sealed by piston rings 23 and 25 or the like as is well known in the art.

The control pressure from valve 21 is conducted to chamber 15 and acts on piston 16, the right end of which forms a hydrostatic bearing face 17 adjacent a ring 18 extending circumferentially around shaft 1 near bearing 3. Fluid is metered to the bearing face, which may include a plurality of fluid pockets 19, through orifices 20.

An increase in manifold discharge pressure will cause a corresponding increase in control pressure from valve 21 which, in turn, displaces piston 16 rightward. Ring 18 is thereupon displaced rightward via the hydrostatic action with bearing face 17, and via a plurality of balls 34 captured on a circumferential flange 35 of a plunger 35, which causes plunger 36 disposed within shaft 1 to pivot swash plate 5 about pin 5A via a ball 38 captured between the plunger and swash plate. Slots 40 in shaft 1 permit balls 34 to transfer the displacement of ring 18 from the outside of shaft 1 to plunger 36

Swash plate 5 is thus displaced from the attitude shown in the FIGURE to a more nearly vertical attitude. This decreases the stroke of piston 6A to reduce fluid flow and, consequently, to reduce the pressure. Equilibrium is thus established and a reduced flow at a pressure near a predetermined substantially constant pressure is maintained.

It will be noted that the major portion of the thrust load actuating swash plate 5 will be taken by the hydrostatic bearing as described. The thrust capacity of bearing 2 may thus be limited, and the invention as herein described represents a distinct improvement over the invention described in the aforenoted U.S. application Ser. No. 796,933. In this connection it is to be understood that ball bearings lubricated with fuel as in the present invention must be significantly derated when calculating their life expectancy by using accepted criteria. The arrangement herein disclosed permits higher discharge pressures without resizing the ball bearings for some particular pressure as might otherwise be the case.

It will also be noted that swash plate 5 is shown in a pivotable arrangement to control the stroke of pistons 6A. Any other hinge joint would serve the purpose of the invention as well. Further, the invention is disclosed and described with reference to the displacement of swash plate 5 in one direction (clockwise) to decrease the stroke of piston 6A, with displacement occurring in the opposite direction as well as to increase the piston stroke, dependent upon manifold pressure, as will now be understood by those skilled in the art.

It will be seen from the foregoing description of the invention with reference to the drawing, that a variable displacement piston pump has been disclosed which is capable of maintaining a predetermined substantially constant pressure with a varying fluid flow. The stroke of the pistons is controlled by the novel arrangement including swash plate 5 being responsive to pump discharge manifold pressure through a hydrostatic bearing arrangement to provide the aforenoted constant pressure with variable fluid flow and to provide the advantages as aforenoted.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. In a variable displacement pump of the type including a drive shaft member, at least one piston and a swash plate mounted about an axis offset from the axis of the drive shaft member and arranged with the piston, and displaced in response to pump discharge manifold pressure for controlling the stroke of the piston upon a thrust load proportional to the discharge manifold pressure being transmitted to the swash plate, means for transmitting the thrust load comprising:

a pump casing containing a fluid;

a differential area piston slidingly arranged within the casing and cooperating therewith to form a chamber for receiving a pressure proportional to the pump discharge pressure;

the differential area piston having a face which forms a hydrostatic thrust bearing;

means for metering the fluid to the hydrostatic thrust bearing; and means coupled to the hydrostatic thrust bearing and to the swash plate for transmitting the thrust load to the swash plate upon the chamber receiving the pressure proportional to the pump discharge pressure including a ring member adjacent the hydrostatic thrust bearing and displaced in response to the thrust load provided thereby, and means arranged with the ring member and the swash plate and responsive to the displacement of the ring member for transmitting the displacement to the swash plate.

2. Means as described by claim 1 wherein:

the fluid metered to the plurality of fluid retaining pockets is at a pressure proportional to the pump discharge pressure.

3. Means as described by claim 1, wherein the face of the differential area piston which forms the hydrostatic thrust bearing includes:

a plurality of fluid retaining pockets cooperating to form the hydrostatic thrust bearing.

4. Means as described by claim 3, wherein the means for metering the fluid to the hydrostatic thrust bearing includes:

at least one orifice communicating with the pump casing and with the fluid retaining pockets for metering the fluid within the casing to said pockets.

5. Means as described by claim 1, wherein the means arranged with the ring member and the swash plate and responsive to the displacement of the ring member for transmitting the displacement to the swash plate includes:

the pump drive shaft member being hollow;

a plunger disposed within the hollow shaft member and carrying a flange;

the ring member disposed on the shaft member near the plunger flange;

a plurality of slots extending around the shaft member and opening to the plunger flange;

a plurality of balls captured between the ring and the slots and communicating with the plunger flange so as to transmit the displacement of the ring to the plunger.

6. Means as described by claim 5, further including:

a ball member captured between the plunger and the swash plate to transmit the displacement of the plunger to the swash plate.

* * * * *